US006186428B1

(12) United States Patent
Robinson et al.

(10) Patent No.: US 6,186,428 B1
(45) Date of Patent: Feb. 13, 2001

(54) BIO-HAZARDOUS WASTE PROCESSOR AND OPTIONAL ENCASEMENT

(75) Inventors: Stanley L. Robinson, Bridgewater; Michael A. Gerber, Lawrenceville; Bernard F. Sarlo, Moorestown, all of NJ (US); Stanley VanClair, Roslyn, NY (US)

(73) Assignee: Steriwaste, Inc., Lawrenceville, NJ (US)

( * ) Notice: Under 35 U.S.C. 154(b), the term of this patent shall be extended for 0 days.

(21) Appl. No.: 09/221,063

(22) Filed: Dec. 28, 1998

(51) Int. Cl.[7] ..... B02C 19/12

(52) U.S. Cl. ..... 241/65; 241/73; 241/100; 241/152.2; 241/606; 241/DIG. 37

(58) Field of Search ..... 241/152.2, DIG. 37, 241/606, 73, 100, 101.78, 101.71, 101.3, 65

(56) References Cited

U.S. PATENT DOCUMENTS

| | | | | |
|---|---|---|---|---|
| 3,750,966 | * | 8/1973 | Anderson | 241/606 |
| 3,926,379 | | 12/1975 | Dryden et al. . | |
| 4,222,527 | * | 9/1980 | Davis | 241/DIG. 37 |
| 4,746,496 | | 5/1988 | Sorochenko et al. . | |
| 4,786,280 | | 11/1988 | Maeda . | |
| 4,809,915 | | 3/1989 | Koffsky et al. . | |
| 4,889,290 | | 12/1989 | Koffsky et al. . | |
| 4,902,482 | | 2/1990 | Faust . | |
| 4,984,748 | * | 1/1991 | Kimura | 241/606 |
| 5,025,994 | | 6/1991 | Maitlen et al. . | |
| 5,035,367 | * | 7/1991 | Nojima | 241/606 |
| 5,046,669 | | 9/1991 | Wallace et al. . | |
| 5,150,844 | | 9/1992 | McKie . | |
| 5,195,685 | | 3/1993 | Domaine . | |
| 5,692,687 | * | 12/1997 | Kateley | 241/DIG. 37 |

* cited by examiner

*Primary Examiner*—Mark Rosenbaum
(74) *Attorney, Agent, or Firm*—Conrad R. Leikauf, Esq

(57) ABSTRACT

A bio-hazardous waste processor and optional encasement is described that uses a coolant such as liquid nitrogen to make the waste brittle in the hopper before crushing, keep the waste brittle in the down chute after crushing and also during shredding in the demolition chamber. After shredding, a fog of sterilant is used to disinfect the waste. The apparatus comprises an input hopper with a crushing wheel and dead plate towards its base to reduce the size of large particles, and a down chute which leads the crushed waste from the crushing wheel to a demolition chamber. In the demolition chamber, shredding is implemented by: one or more hammers and one or more commercially available off-the-shelf saw blades, the hammer(s) and saw blade(s) rotating in the same or opposite directions; or, one or more commercially available off-the-shelf dado saw blades, adjacent dados rotating in opposite directions. A sifter plate, with numerous apertures, allows shredded waste smaller than a selected size to fall from the demolition chamber to a fogging chamber where atomizers provide a fog of sterilant for decontamination. The decontaminated shredded waste is collected in a bag. An optional movable airtight encasement has an air intake and air filter to reduce the differential between the exterior and interior air pressure caused by pressure from the coolant and sterilant and also to provide an extra measure of safety that may be required in some installations.

13 Claims, 16 Drawing Sheets

100

440
445
446
447
443
441
442
444
43
47

200

BIO-HAZARDOUS WASTE PROCESSOR AND OPTIONAL ENCASEMENT

FIELD OF THE INVENTION

This invention relates to apparatus for decontamination and disposal of bio-hazardous waste.

BACKGROUND

Many areas in the United States and abroad are facing the problem of safe handling and disposal of medical waste. The situation is aggravated as the number of generating sites multiply. Any contact with bodily fluids generates medical waste, so hospitals, nursing home facilities, home health care services, dental offices, dialysis centers, funeral homes, and many more locations become generators. Problems of disposal are increased by the cost of safe handling which encourages illegal dumping and fouling of beaches with medical waste. There is also an exposure problem in transporting infectious medical waste to incineration sites. The materials requiring safe disposal range from soft bandages and rubber gloves, to paper, textiles, glass, plastics and steel needles.

This bio-hazardous waste has a range of hardness and includes bandages, plastic devices, adhesive tapes, hypodermic syringes or needles, intravenous (IV) needles, surgical gloves, and bottles. This contaminated medical waste is bulky and many truckloads are required when carting this material from large generators or pickup points. While in transport the material remains bio-hazardous. There is a serious liability exposure if a bag accidently falls off the truck while in transit to secondary processing such as incineration. Government agencies are dissatisfied with the incineration system and it is expensive.

Several attempts have been made to solve the medical waste disposal problem by destroying and disinfecting medical waste on site but many of these machines use special blades, cutters, knives or rotors that are expensive to manufacture and maintain and cannot handle both soft gloves and hard glass and steel needles in the same batch. Current machines that use heat for sterilizing cannot handle a wide range of waste in the same batch because some soft items would vaporize, possibly giving off noxious or toxic gasses, before other items would be sterilized.

Some related art shows using vapors to maintain sterilization, not to sterilize. Applying disinfectant to waste prior to completely reducing the pieces to their final size does not insure that all of the surface area of the waste is exposed to disinfectant.

For the foregoing reasons, there is a need for a machine that can handle a variety of bio-hazardous waste in the same processing batch, that is less costly to manufacture and maintain, thus available to more waste generators, and of a scalable design both on volume of waste processed and size of waste items.

SUMMARY

The present invention utilizes some commercially available off the shelf components to reduce manufacturing and maintenance costs, accepts a wide range of soft and hard bio-hazardous medical waste and is scalable. All the waste is subjected to cooling to make even the soft waste materials such as surgical gloves brittle enough for shredding. The waste is crushed to make it suitable for shredding, Further cooling is provided after the waste has been crushed but before it is shredded. This brittle crushed waste is kept brittle by continued cooling in an enclosed demolition chamber and then shredded by inexpensive, commercially available off-the-shelf, replaceable saw blades. The saw blades can be interspaced with hammers, the hammers rotating in the same or in the opposite direction from that of the saw blades. Dado saw blades wherein adjacent blades rotate in opposite directions can be used. The shredded waste then falls into a fogging chamber where the fine pieces are disinfected so that surfaces such as formerly inside-out contaminated gloves will be sterilized, not just the uncontaminated former inside of such a glove. The present invention can utilize a variety of sterilants for disinfecting. As better liquid or gaseous disinfectants emerge, the system can easily utilize them. The shredded decontaminated waste continues into a biodegradable storage bag which can be easily removed from the machine. The present invention includes an optional air tight encasement with an air intake and a filter. This air intake and filter is used to replace air in the airtight encasement, maintains a closer balance to the differential between the internal pressure and the atmospheric pressure and also provides an extra measure of safety that may be required in some installations.

These and other features, aspects and advantages of the present invention will become better understood with regard to the following description, appended claims and accompanying drawings.

DETAILED DESCRIPTION

Figure 1:
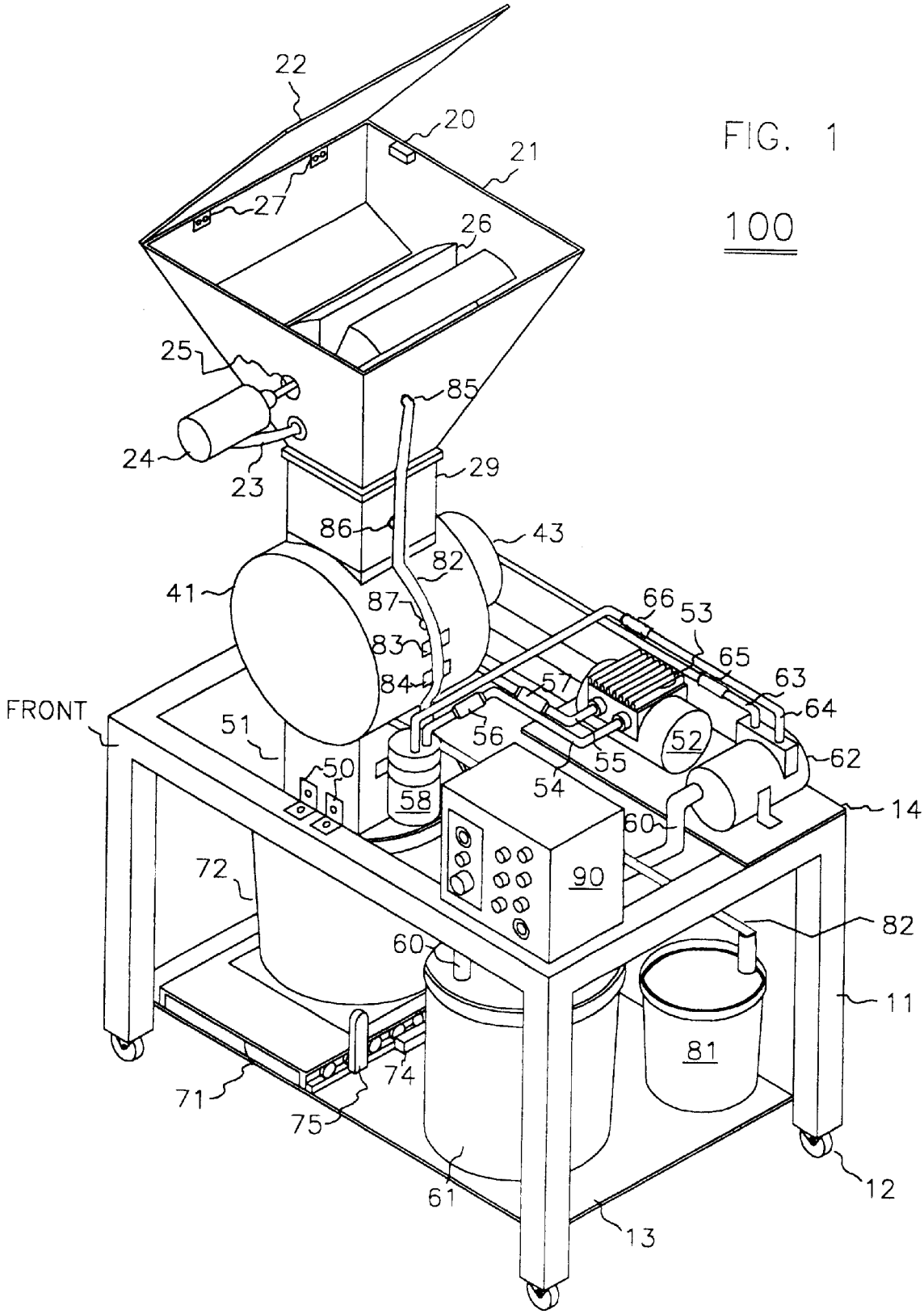
FIG. 1 is a front perspective view of the bio-hazardous waste processor.
Figure 10:
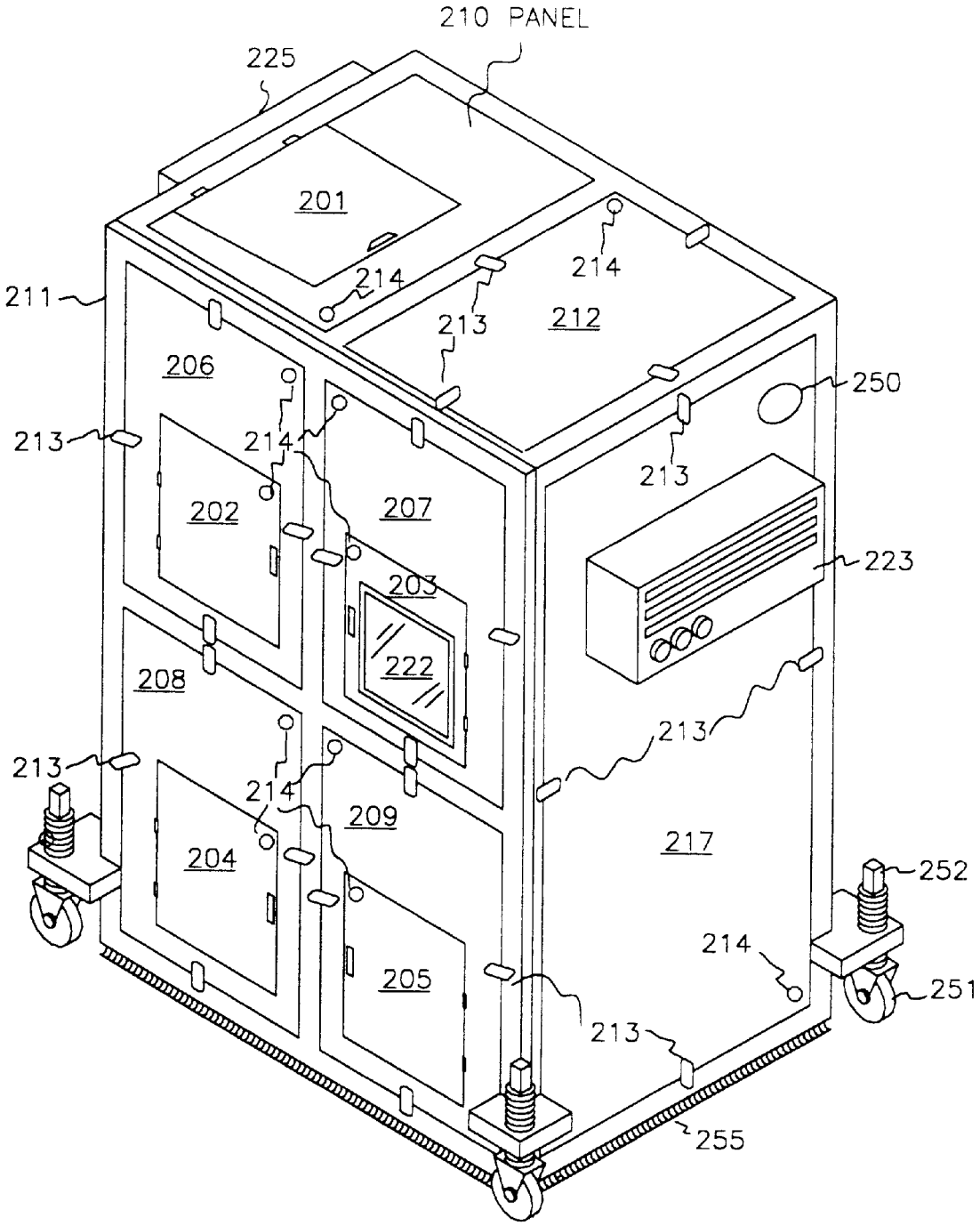
FIG. 10 is a perspective view of the top, front and right of the encasement.
Figure 10A:
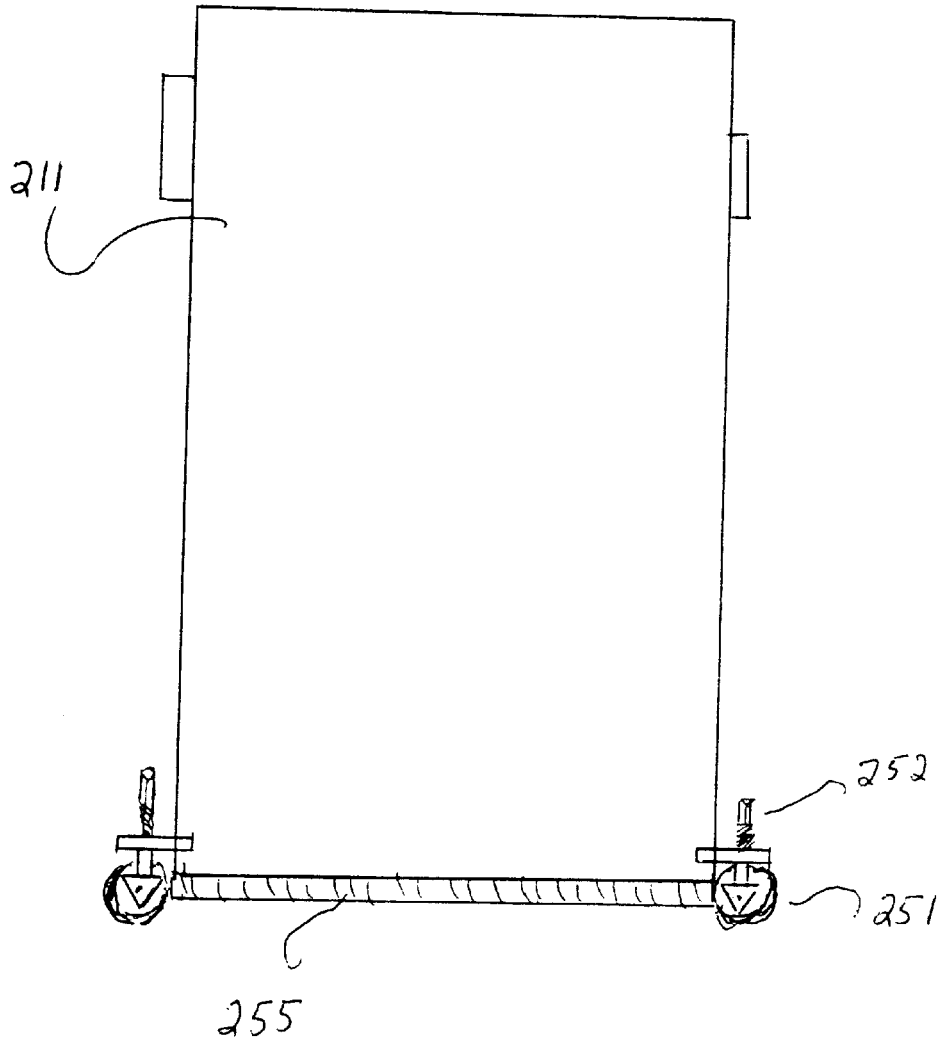
FIG. 10A is a view of the back of the encasement of FIG. 10.
Figure 11:
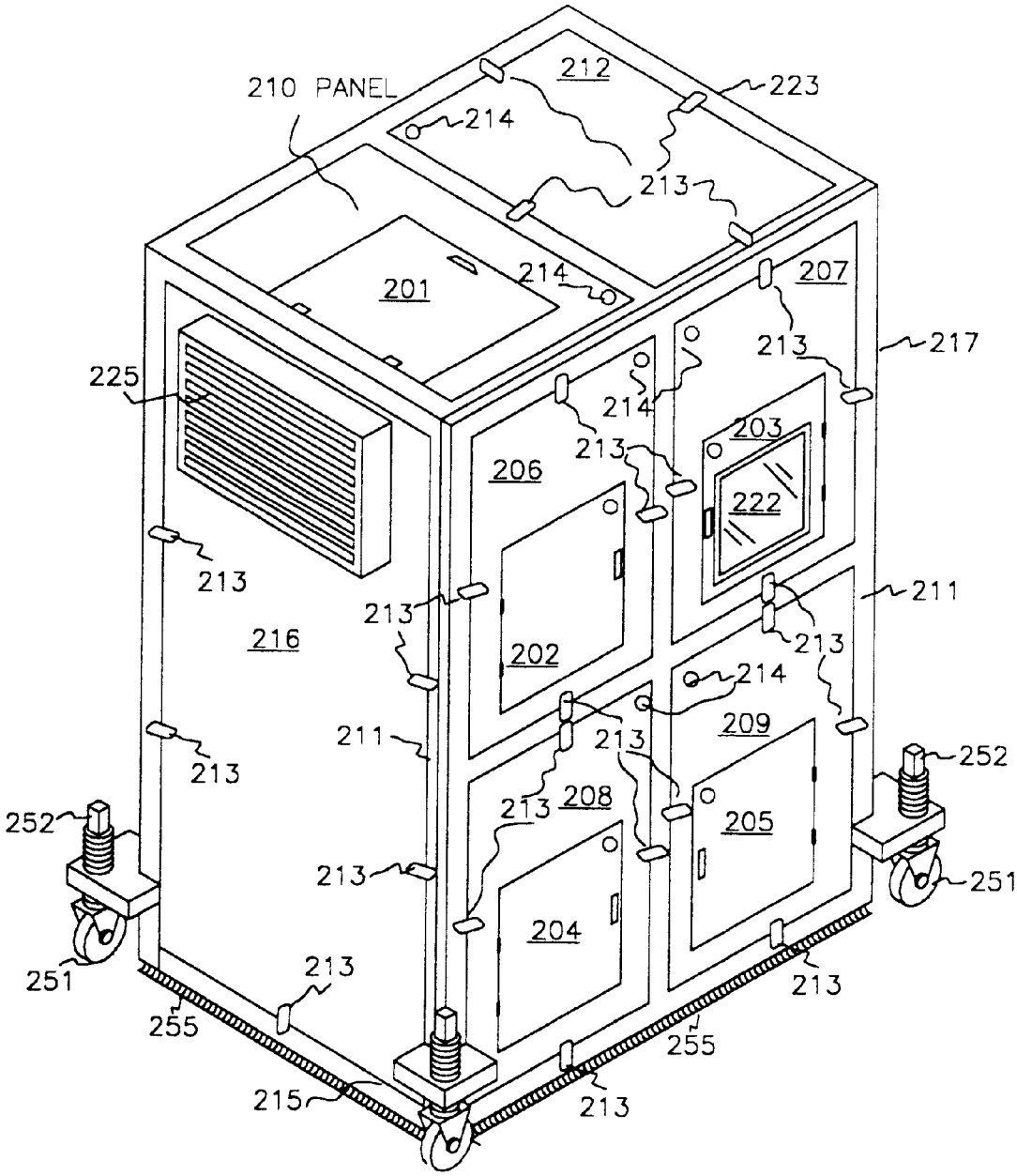
FIG. 11 is a perspective view of the top, front and left of the encasement of FIG. 10.

A device for rendering bio hazardous waste harmless by brittilizing, shredding and disinfecting, constructed according to the principles of the present invention, has an interior bio-hazardous waste processor portion 100, indicated in FIG. 1, and an optional airtight encasement portion 200 as indicated in FIGS. 10, 10A and 11.

Referring to FIG. 1, frame 11 in the preferred embodiment is similar in shape to a rectangularly shaped, open-topped table with four legs and can be made of metal, plastic or similarly rigid material and in the preferred embodiment is made of metal. One long side of the rectangle is arbitrarily selected to be the front. The bio-hazardous waste processor 100, is built on frame 11. Movability is provided in the preferred embodiment by swivel casters 12 which are attached to the base of the legs of the frame 11. Lower mounting plate 13 fits inside frame 11 and must be strong enough to hold the various components and waste that bear down upon it. Lower mounting plate 13 is positioned above the swivel casters 12. Upper mounting plate 14 must be strong enough to hold the various components that bear down upon it and is mounted on the upper right-hand rear corner of frame 11.

Figure 12:
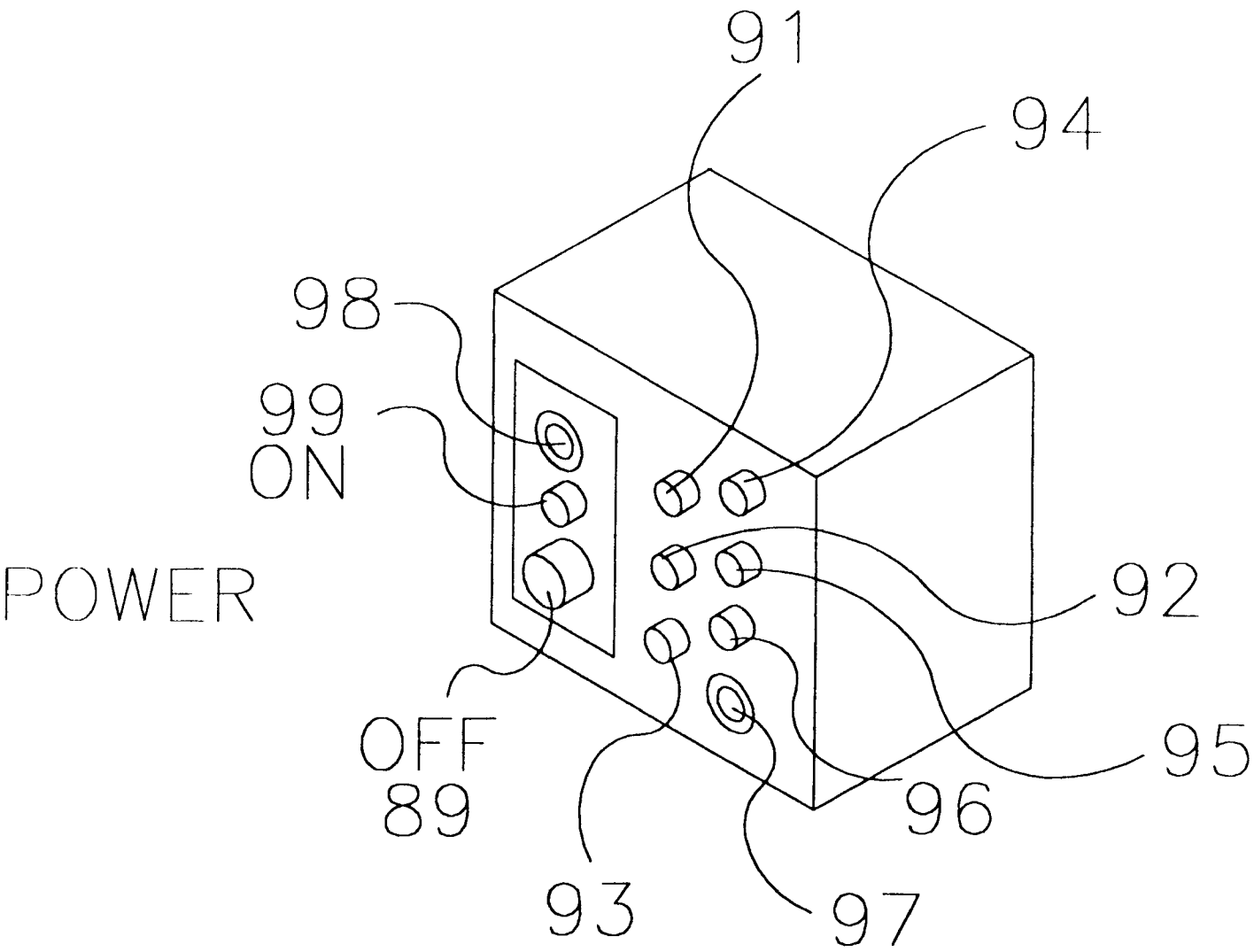
FIG. 12 is a view of the control panel of the machine of FIG. 1.

Referring to FIG. 12, control box 90 comprises equipment to control the operation of the bio-hazardous waste processor 100 and, in the preferred embodiment also the encasement 200, to receive and process the various status signals and interlocks, and to provide a visual status and interlock display and audible warning signal. Power on button 99 is mounted on the face of control panel 90. Power on indicator lamp 98 is mounted above power on button 99 on control panel 90. Power off button 89 is mounted below power on button 99 on control panel 90. Seven status lamps, 91–97, are mounted on the face of control box 90. Referring to FIG. 1, control box 90 is mounted on the upper right hand front corner of frame 11, across from upper mounting plate 14.

Figure 2A:
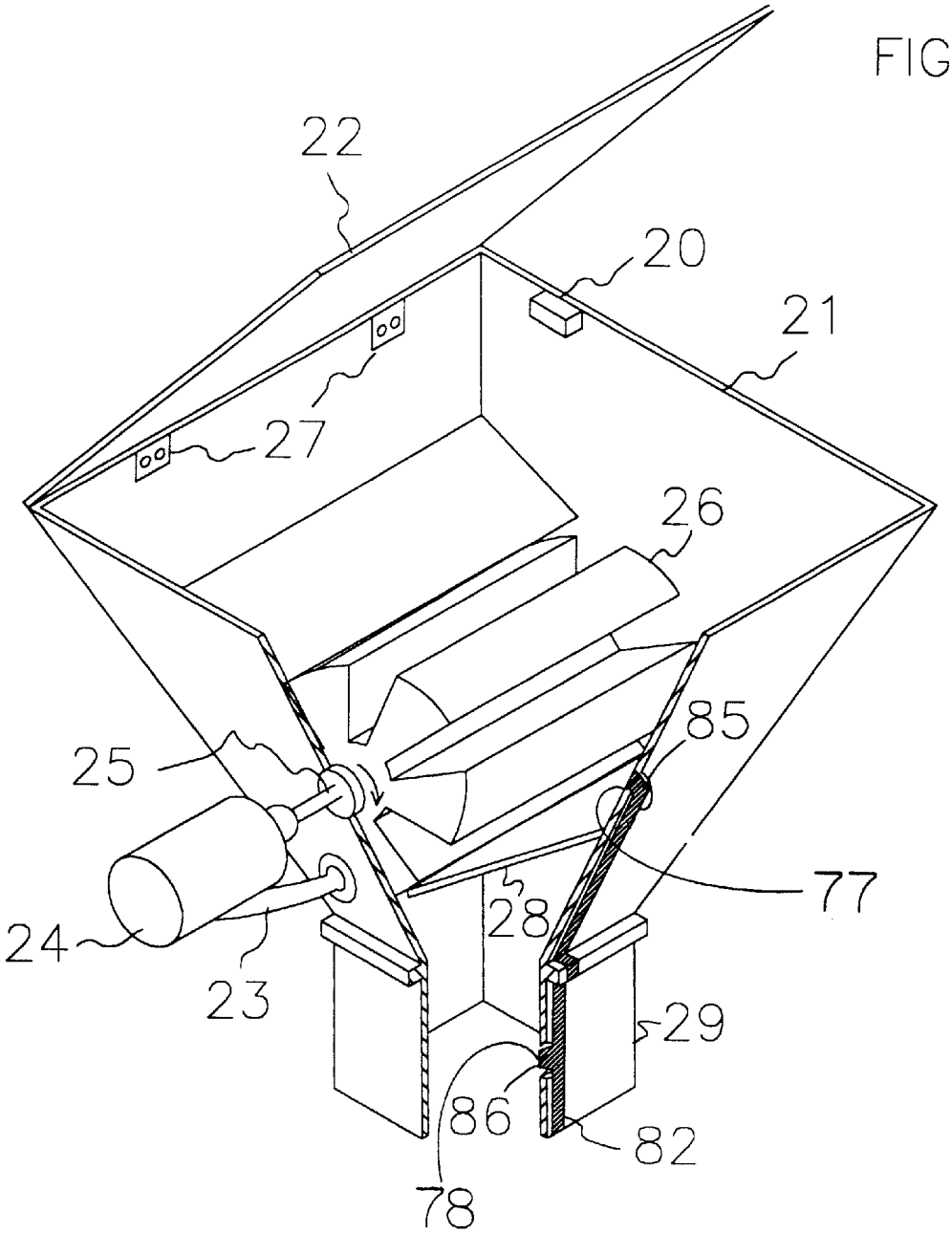
FIG. 2A is a view of the input hopper and crushing wheel of the machine of FIG. 1.

Referring to FIG. 2A, hopper 21 receives the bio-hazardous waste to be processed. Hinge 27 attaches hopper 21 to hopper cover 22, which, when closed, closes safety electrical interlock relay 20, sending a hopper closed status signal to control box 90.

One skilled in the art can use many ways of making bio-hazardous waste brittle by lowering its temperature, but in the preferred embodiment, a cooling liquified gas is used. Referring to FIGS. 1 and 2A, resting on lower mounting plate 13 is cooling agent canister 81. Liquid nitrogen is selected because of its availability but one skilled in the art can substitute other cooling agents to make the waste brittle. The coolant supply delivery system takes the coolant from its supply and delivers it to where it is needed. Liquid nitrogen flows through insulated metal tubing 82, regulated by coolant pressure control 83 and detected by pressure relay 84, through at least one orifice 77 via at least one port 85 into hopper 21. If sufficient coolant pressure is detected, pressure relay 84 sends a sufficient coolant pressure signal to control panel 90.

Figure 2B:
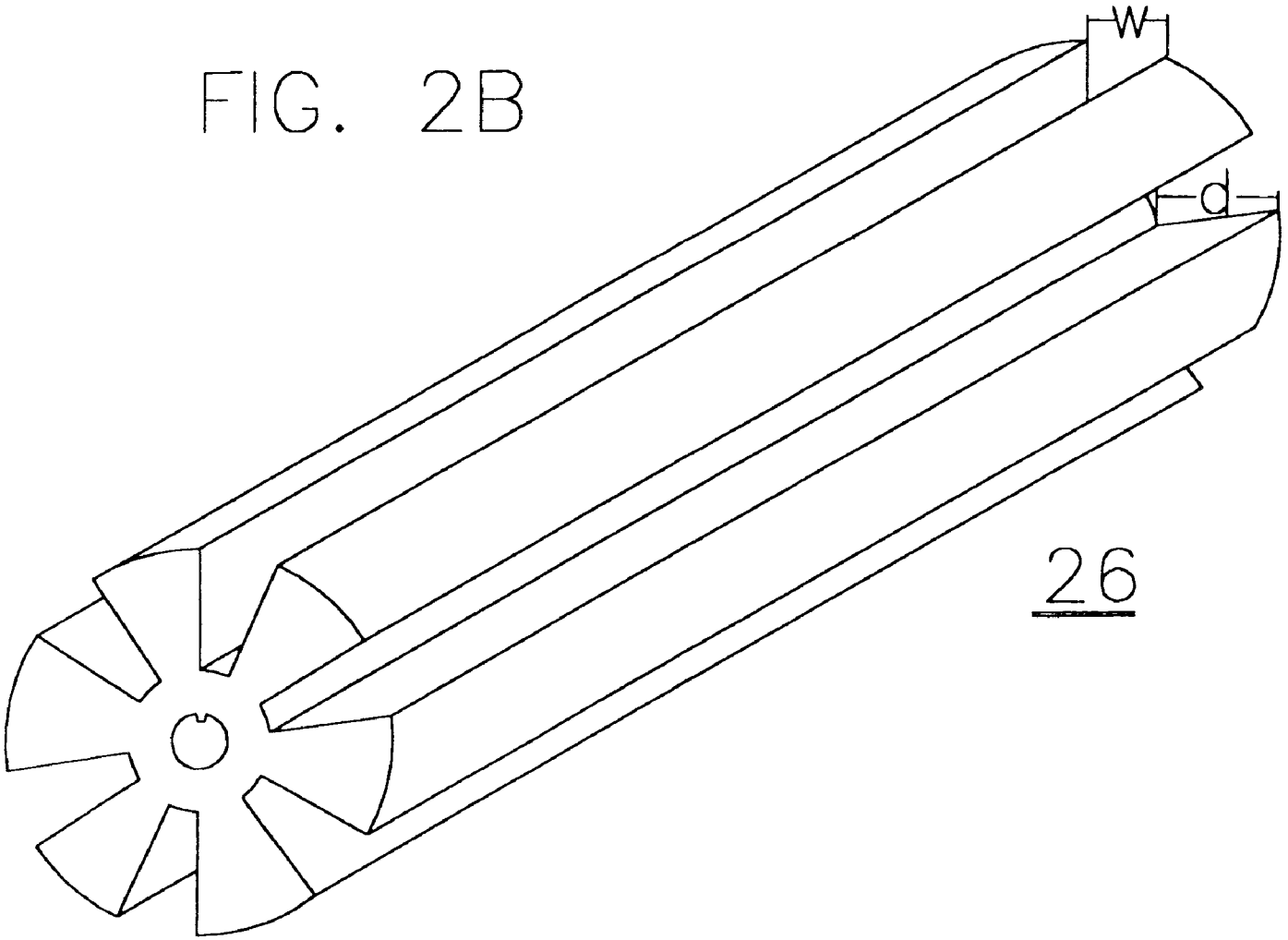
FIG. 2B is a view of the crushing wheel of FIG. 2A.

Referring to FIG. 2A, mounted inside hopper 21 is dead plate 28. Also mounted on hopper 21, supported by motor mount 23, is motor 24 of approximately ½ HP. Shaft 25 is connected to, and rotated in a clockwise direction by, motor 24. Crushing wheel 26 is composed of a hard material such as steel, sufficiently hard to withstand use on glass and steel syringes and is sufficiently wide to allow its outer edges to approach the sides of the hopper to within approximately 1/16 inch at its closest point. The diameter of crushing wheel 26 in the preferred embodiment is approximately 6" in diameter. Referring to FIG. 2B, crushing wheel 26 has longitudinal grooves that have a depth d. The depth d in the preferred embodiment is 2 inches but is variable depending on the material to be crushed. For large objects such as bottles, crushing wheel 26 is approximately 8 inches in diameter and depth d would be about 3 inches. If only thin material such as syringes and gloves are processed depth d can be as shallow as ¼ inch. The longitudinal grooves have an arc width w of approximately 1 inch at the outer circumference. Referring to FIG. 2A, crushing wheel 26 is mounted on shaft 25. The distance between crushing wheel 26 and dead plate 28 varies with the material to be crushed and in the preferred embodiment is approximately 2 inches. Crushing wheel 26, in conjunction with dead plate 28, crushes large objects such as bottles, and crushing wheel 26 then moves the crushed material past dead plate 28. Down chute 29 is attached to the base of hopper 21 and receives the crushed waste. Pressure regulated liquid nitrogen also flows through at least one insulated metal tubing 82, through at least one orifice 78 via at least one port 86 into down chute 29 to keep the waste brittle.

Figure 3B:
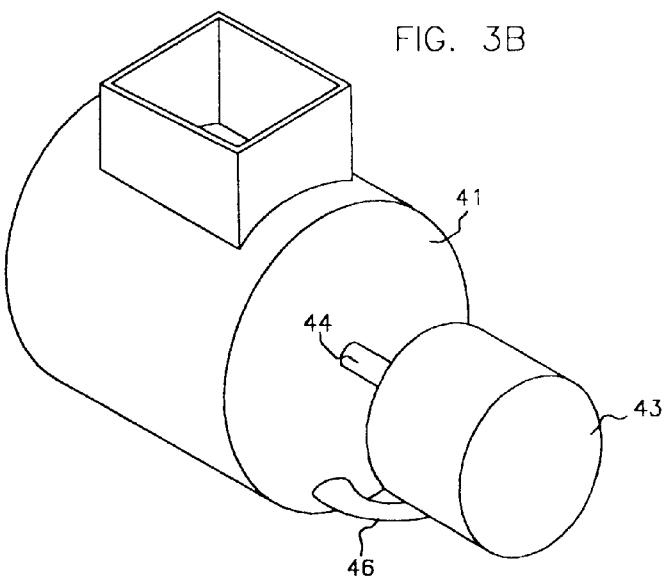
FIG. 3B shows the demolition chamber and blade motor of the machine of FIG. 1.
Figure 3D:
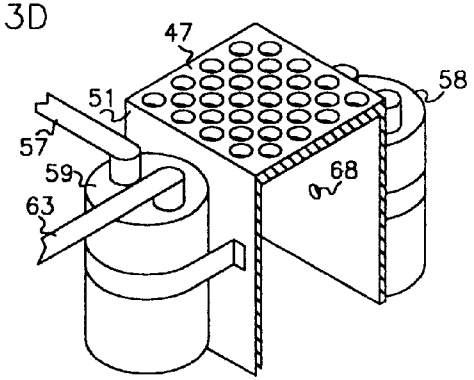
FIG. 3D is a perspective view from the left of the fogging chamber, sifter plate and atomizers of the machine of FIG. 1.
Figure 3A:
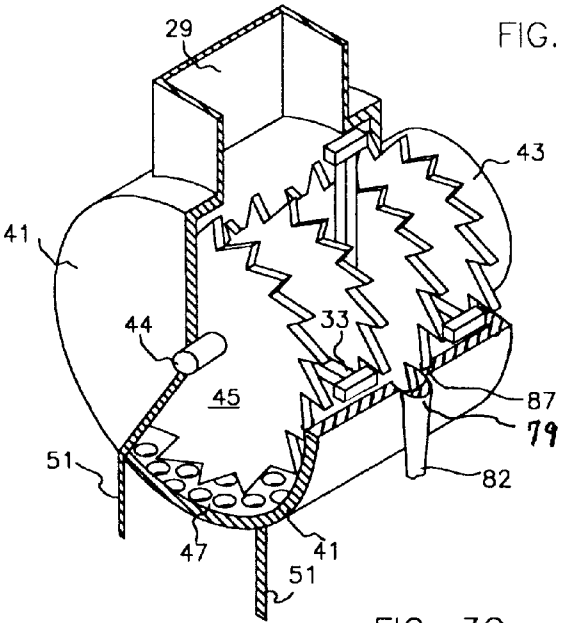
FIG. 3A is a view of the down chute, demolition chamber, saw blades, hammers and the sifter plate of the machine of FIG. 1.
Figure 4:
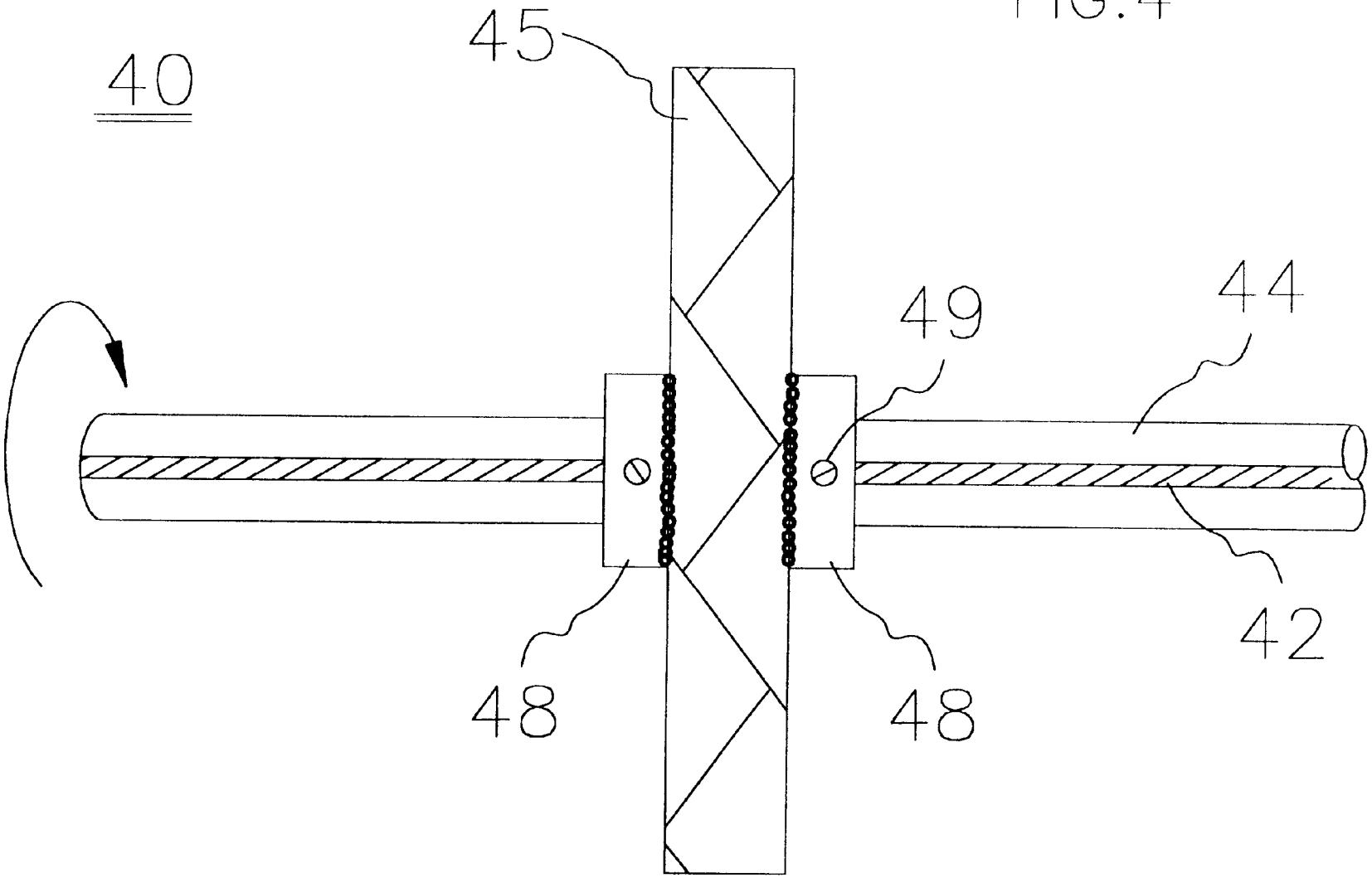
FIG. 4 is a view of a saw blade assembly mounted on a shaft of the machine of FIG. 1.

Referring to FIGS. 1 and 3A, demolition chamber 41 is attached to the bottom of down chute 29. Referring to FIG. 3B, motor mount 46 attaches motor 43, approximately ½ HP, to the exterior of the demolition chamber 41. Referring to FIGS. 1 and 3A, waste falling through the down chute 29 enters the demolition chamber 41. Pressure regulated liquid nitrogen also flows through insulated metal tubing 82, through orifice 79 via port 87 into demolition chamber 41 to keep the waste brittle. Referring to FIG. 4, shaft 44 has a flattened recessed surface 42 along its long axis sufficiently wide to allow a set screw to be used. Referring to FIG. 3B, shaft 44 is rotated by motor 43 at a high enough speed so that waste is shredded, not pushed around, but not above the design specifications of a saw blade. In the preferred embodiment, shaft 44 is rotated at approximately 1700 RPM.

Referring to FIG. 4, saw blade 45 is selected from commercially available off-the-shelf saw blades which typically range from 5½ inches to 12 inches in diameter. In the preferred embodiment, saw blade 45 is a 7¼ inch diameter commercially available off-the-shelf carbide, diamond or similarly hardened tipped saw blade. If saw blade 45 is 10 inch or larger, then motor 43 should be approximately ¾ HP. Blade collar 48 has locking set screw 49 to secure it to a shaft and is selected to provide a snug fit over shaft 44. Still referring to FIG. 4, the shredding saw blade assembly 40 is comprised of saw blade 45 with two collars 48 welded to it, one on each side, concentric to saw blades 45, with locking set screws 49 in line on a plane through the center of the saw blade 45 and collars 48.

Figure 5:
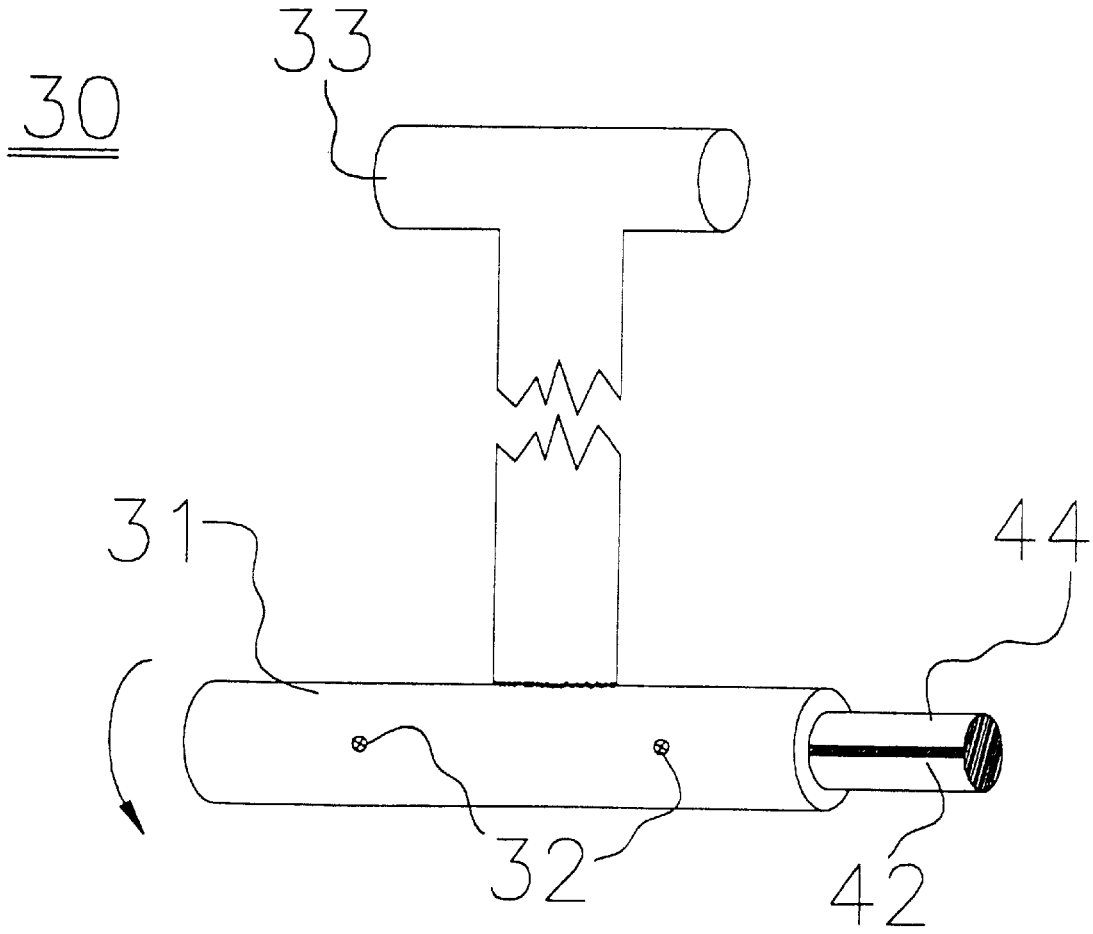
FIG. 5 is a view of a hammer/sleeve assembly mounted on a shaft of the machine of FIG. 1.

Referring to FIG. 5, sleeve 31 is selected to fit snugly on shaft 44. Sleeve 31 has two locking setscrews 32 in line along the long axis of sleeve 31 to secure it to a shaft. Hammer 33 is made of a strong material such as steel. Hammer/sleeve assembly 30 is comprised of hammer 33 attached to sleeve 31 which has two locking setscrews 32.

Referring to FIGS. 3A, 4 and 5, a plurality of shredding saw blade assemblies 40 are mounted on shaft 44 and held in place by locking set screws 49 being tightened against flattened recessed surface 42 of shaft 44. The shredder implements in this embodiment are at least one saw blade assembly 40 and one hammer/sleeve assembly 30. In the preferred embodiment, four saw blade assemblies 40 are used and between two adjacent shredding saw blade assemblies 40 is a hammer/sleeve assembly 30 mounted on shaft 44 and held in place by locking set screws 32 being tightened against flattened recessed surface 42 of shaft 44. If a plurality of hammer/sleeve assemblies 30 is used, it is possible to stagger their effect by changing the relationship of the attachment of hammer 33 to the location of the setscrews 32 of sleeve 31. The degree of lead or lag between hammers 33 is dependent upon the number of hammers included and ranges from approximately 30 degrees to a full 180 degrees. Referring to FIG. 3A, the preferred embodiment shows four shredding saw blade assemblies 40 separated by three hammer/sleeve assemblies 30 wherein the center hammer 33 lags the two outside hammers 33 by approximately 90 degrees.

Figure 6:
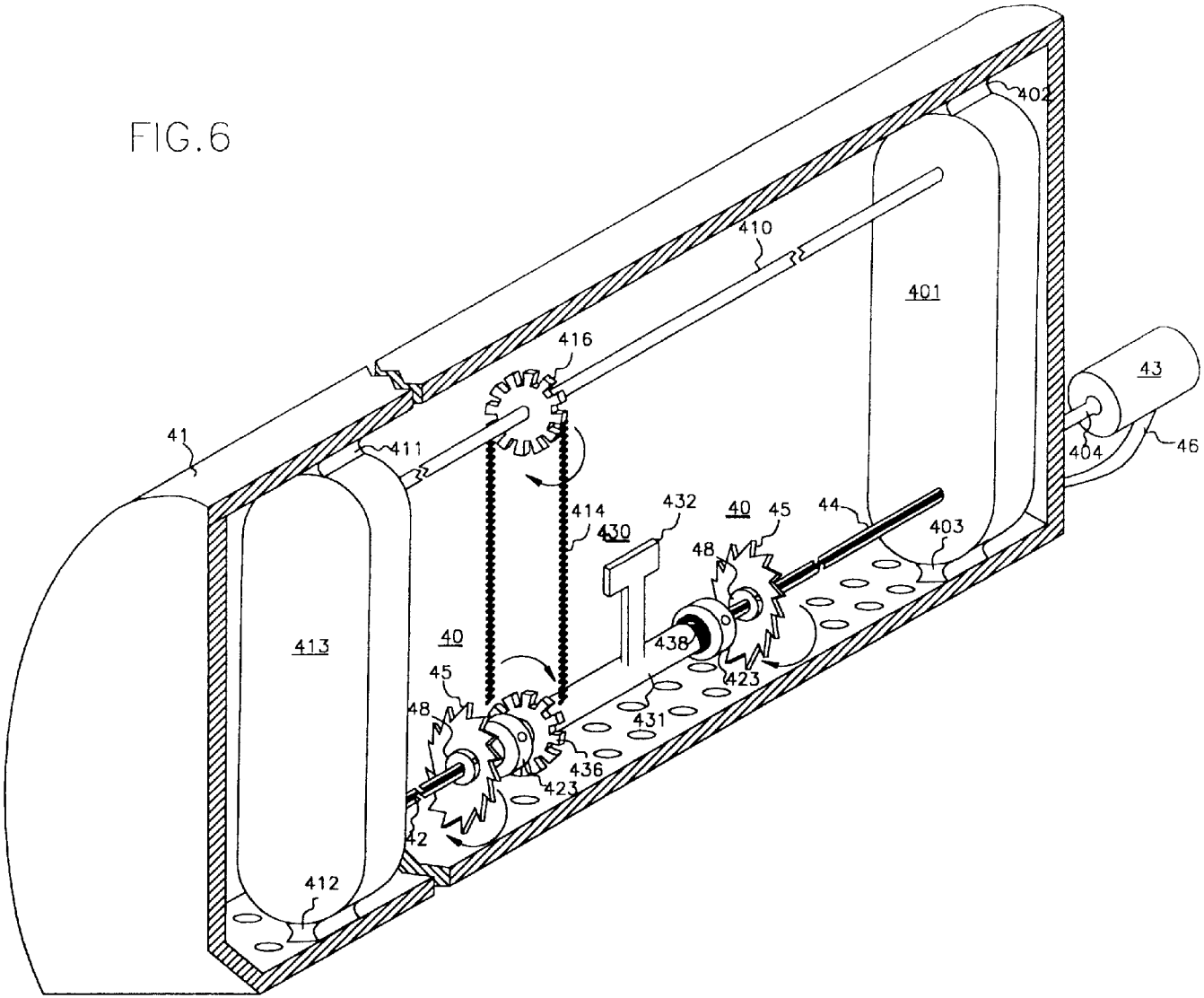
FIG. 6 is a cutaway view of another embodiment of the machine showing the demolition chamber with alternating saw blade assembly and counter rotating hammer/sleeve assembly with one safety shield removed of the machine of FIG. 1.

As an alternative, the shredding saw blade can rotate in the direction opposite that of the hammer. Referring to FIG. 6, one safety shield has been removed to show the relationship between sprockets. In this embodiment, transmission 401 is able to rotate two shafts in different rotational directions from a single power source. Transmission 401 is mounted in the interior of demolition chamber 41 by upper mounting bracket 402 and lower mounting bracket 403. Motor 43 is approximately ¾ HP and powers transmission 401 via shaft 404. Shaft 44 is mounted inside demolition chamber 41 and rotated by transmission 401. Transmission 401 rotates shaft 44 at a high enough speed so that waste is shredded, not pushed around, but not above the design specifications of the blade. In this embodiment, shaft 44 is rotated at approximately 1700 RPM. Shaft 410 is mounted inside demolition chamber 41 parallel to and spaced sufficiently apart from shaft 44 so that the shredding saw blade assembly 40 and the hammer assembly 30 have sufficient clearance. In this embodiment, shaft 410 is mounted above shaft 44. In this embodiment, transmission 401 rotates shaft 410 at approximately twice the speed of shaft 44.

Figure 8:
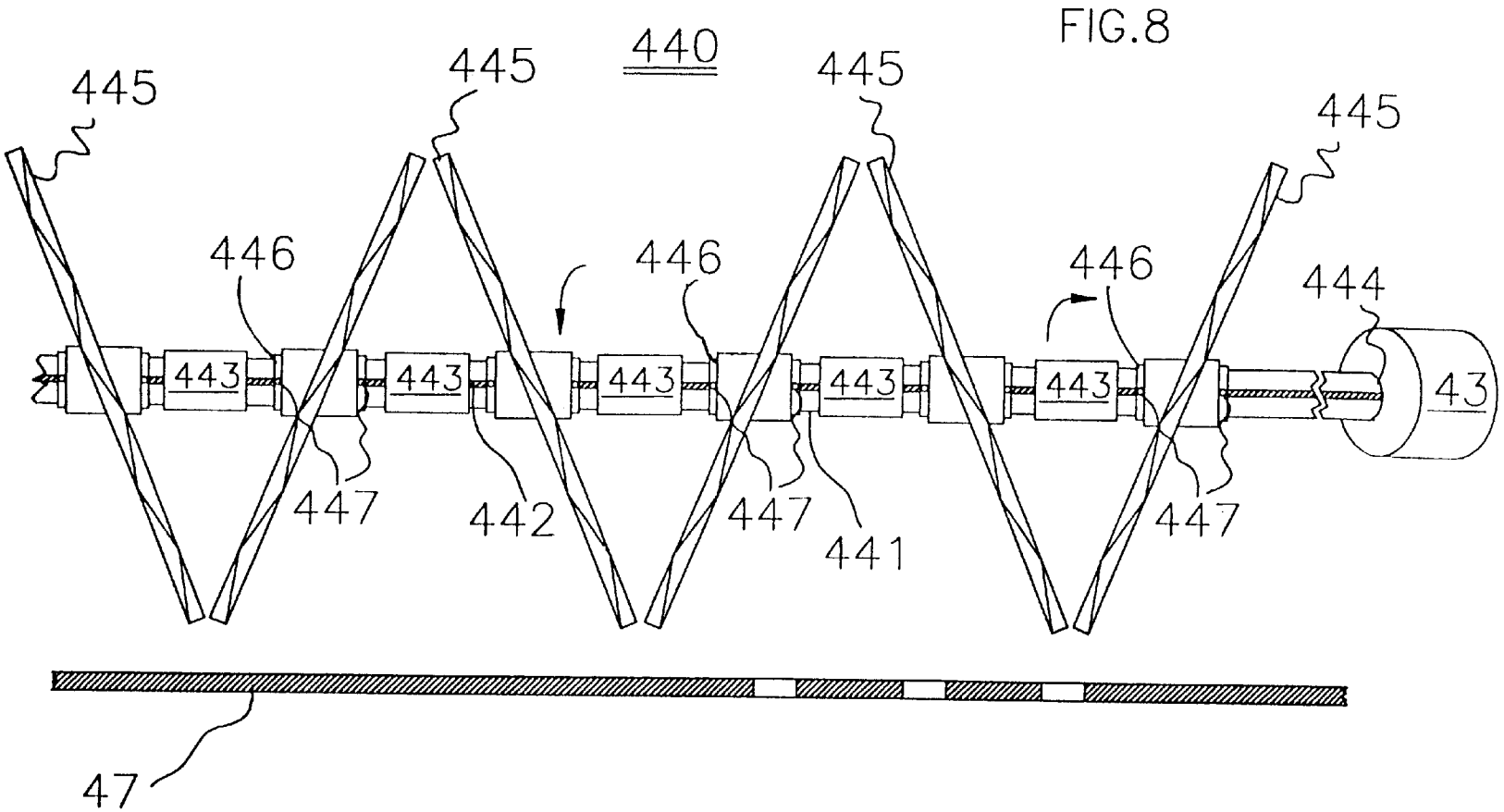
FIG. 8 is a view of another embodiment of the invention showing dado saw blades on a counter-rotating segmented shaft arrangement using a reversing transmission of the machine of FIG. 1.
Figure 8A:
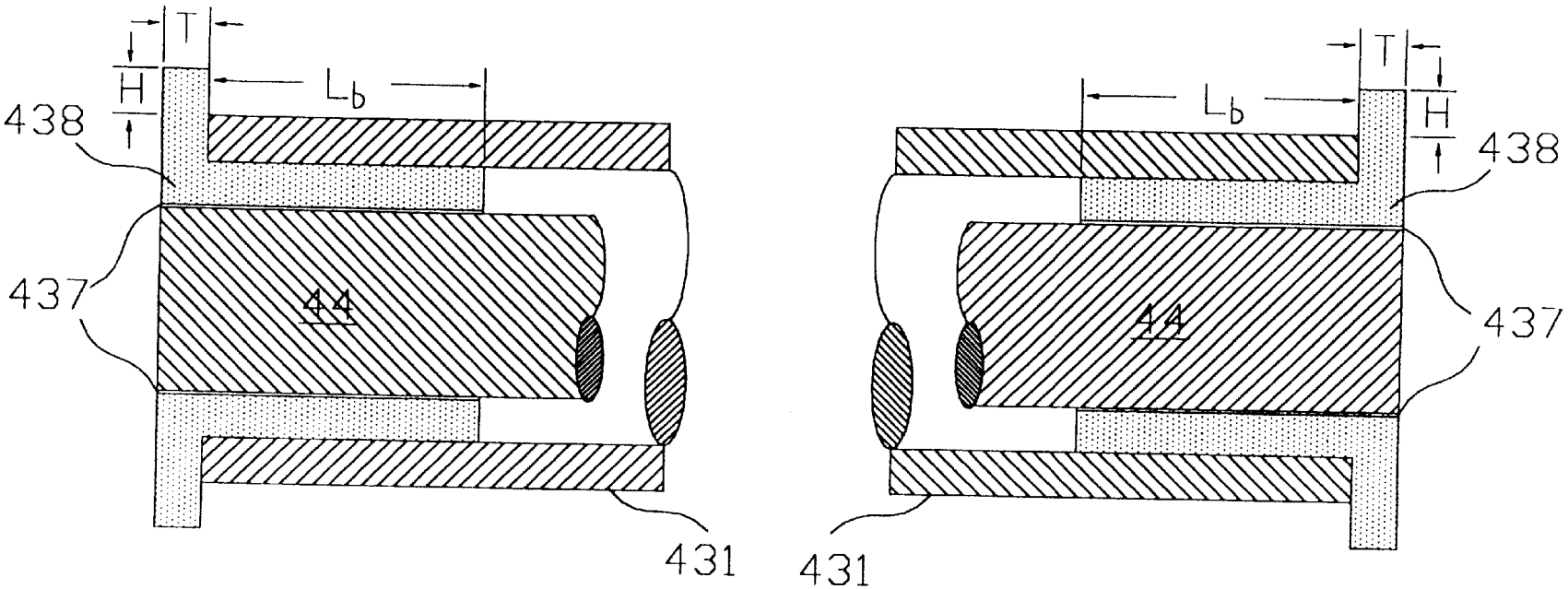
FIG. 8A is a view of the bushing inside the sleeve and around the shaft of the machine of FIG. 1.
Figure 8B:
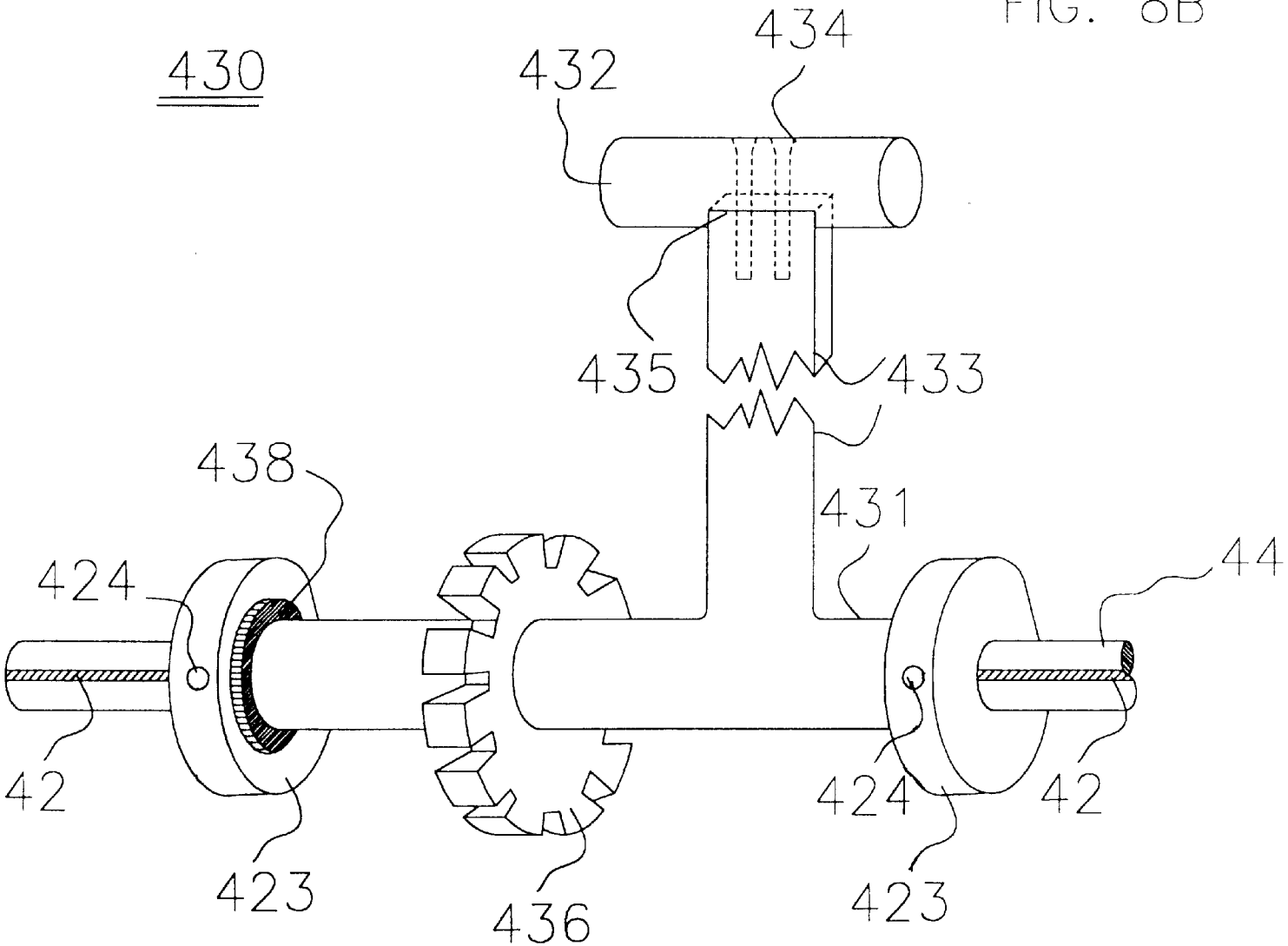
FIG. 8B is a view of the rotatable sleeve assembly, with collars, mounted on a shaft of the machine of FIG. 1.

Referring to FIGS. 8A and 8B, rotatable sleeve 431 has a hollow sufficiently oversized to allow a bushing or bearing to be placed between shaft 44 and rotatable sleeve 431 to allow rotatable sleeve 431 to rotate independently of shaft 44. Rotatable sleeve 431 has a hammer arm 433. Hammer arm 433 is drilled and tapped to receive screws 434. Hammer 432 has slot 435 to receive hammer arm 433 and is drilled to allow screws 434 to pass through. Hammer arm 433 is fixed in slot 435 of hammer 432 and secured with two screws 434. Rotatable sleeve 431 also has sprocket 436 fixedly attached such that sprocket 436 can be utilized for driving the rotatable sleeve 431.

Referring to FIG. 8A, bushing 437 in the this embodiment is made of Teflon and is a hollow cylinder with a flange 438 on one end. The diameter of the hollow is such that the bushing 437 fits over main shaft 44 with a minimum of clearance as determined by one skilled in the art. Referring to FIGS. 8A and 8B, the length of bushing 437 is less than ½ the length of rotatable sleeve 431 such that one bushing 437 can be placed inside each end of rotatable sleeve 431. In this embodiment the length of bushing 437 is approximately ¾ inch long. Referring to FIG. 8A, flange 438 has a height H which is sufficiently high to provide a surface for a collar to ride against while keeping rotatable sleeve 431 in place and in this embodiment is approximately ¼ inch high. Flange 438 has a thickness T that is thick enough to allow for infrequent replacement due to wear and in this embodiment is approximately ¼ inch thick.

Referring to FIG. 8B, collar 423 is designed to eliminate lateral movement of rotatable sleeve 431 when it is used on shaft 44, to retain bushing 437 in its position in rotatable sleeve 431 and is selected to fit snugly on shaft 44. Collar 423 has locking setscrew 424 so that it can be secured to a flattened surface of a shaft.

Referring to FIG. 8B, rotatable sleeve assembly 430 is comprised of rotatable sleeve 431 that has sprocket 436 and hammer arm 433, hammer 432 that has slot 435, two screws 434 and with two bushings 437, all assembled according to this teaching.

Figure 7:
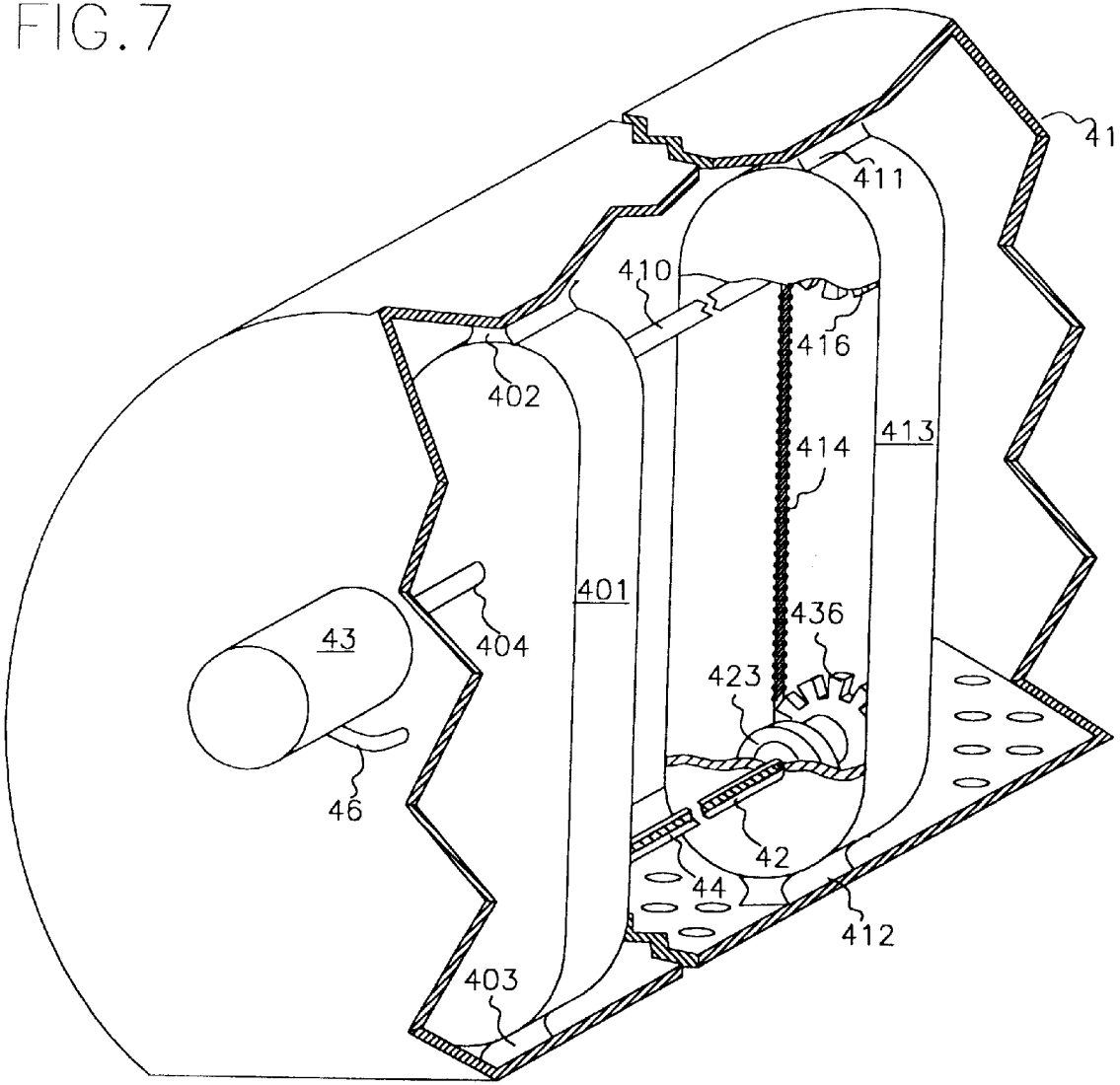
FIG. 7 is a view of the demolition chamber with safety shield mounted of the embodiment referred to in FIG. 6.

Referring to FIG. 6, one safety shield has been removed to show the relationship of the sprockets. Upper shaft 410 has sprocket 416 paired with and affixed to be in line with a sprocket 436 of rotatable sleeve 431 that is mounted on shaft 44. Drive chain 414 lies over sprockets 416 and 436 causing rotatable sleeve assembly 430 to rotate in a direction opposite to that of main shaft 44 and shredding saw blade assembly 40. Sprocket 416 is approximately the same diameter as sprocket 436 so that rotatable sleeve assembly 430 rotates at approximately the same speed as upper shaft 410. If a plurality of rotatable sleeve assemblies 430 are used, lead or lag of the individual hammer 432 can be adjusted by placing the individual rotatable sleeve assembly 430 in a lead or lag position relative to other rotatable sleeve assemblies 430 and securing this relationship by attaching drive chain 414. Referring to FIG. 7, safety shield 413 is attached in the interior of demolition chamber 41 by upper mounting bracket 411 and lower mounting bracket 412 and encases drive chain 414 and sprockets 416 and 436 to minimize the amount of debris that could interfere with the operation of sprockets 416 and 436 and drive chain 414. Referring to FIGS. 6 and 7, care must be taken so that safety shield 413 does not interfere with the operation of the saw blade 45 and the hammer 432.

Referring to FIG. 6, the shredder implements are at least one rotatable sleeve assembly 430, secured in place by two collars 423, and one shredding saw blade assembly 40.

In this embodiment a plurality of shredding saw assembly 40 and at least one rotating sleeve assembly 430 can be employed by alternating rotating sleeve assembly 430 secured by pairs of collars 423 with shredding saw blade assembly 40.

Referring to FIG. 8, dado saw blades rotating in opposite directions are another expression of this invention. In this embodiment, at least one commercially available off-the-shelf dado saw blade is the shredder implement.

Dado saw blade 445 is selected from commercially available off-the-shelf dado saw blades which typically range from 5½ inches to 12 inches in diameter. In this embodiment, the saw blade 445 is a 7¼ inch diameter commercially available off-the-shelf carbide, diamond or similarly hardened tipped dado saw blade.

Shaft segment 441 has a flattened recessed area 442 along its long axis sufficient to allow a setscrew to be used against it. Reversing transmission 443 is designed to accept a shaft segment 441 on one side and reverse the direction of the rotation to another shaft segment 441 connected to the other side of reversing transmission 443. Reversing transmission 443 is sealed to protect its mechanism from debris.

Segmented shaft 444 contains a plurality of shaft segments 441 coupled by reversing transmissions 443 such that each shaft segment 441 rotates in the direction opposite to adjacent shaft segments 441 of segmented shaft 444.

Segmented shaft 444 is mounted inside demolition chamber 41 and is rotated by motor 43. If saw blade 445 is 10 inch or larger, then motor 43 should be approximately 1 HP. Rotation speed must be sufficient to allow the waste to be shredded, not just pushed around, but not exceed the design specifications of the blade, and in this embodiment is approximately 1700 RPM.

Blade collar 446 is selected to provide a snug fit over shaft segment 441 and has locking set screw 447. Shredding dado saw blade assembly 440 is comprised of a dado saw blade 445 with two collars 446 welded to it, one on each side, concentric to dado saw blades 445, with locking set screws 447 in line on a plane through the center of the saw blade 445 and collars 446, attached and held in place on shaft segment 441 by locking set screws 447 being tightened against flattened recessed surface 442.

Adjacent dado blades 445 are adjusted so that there is about ¼ inch between the blades at their closest approach to each other at the bottom and such that the maximum number of blades have their closest approach near the bottom.

If only one dado saw blade assembly 440 is used, shaft 441 is directly attached to motor 43 and there is no need for reversing transmission 443.

Figure 3C:
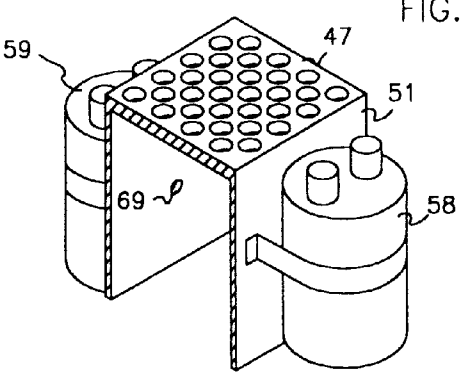
FIG. 3C is a perspective view from the right of the fogging chamber, sifter plate and atomizers of the machine of FIG. 1.

Referring to FIG. 3A, sifter plate 47 is attached to the bottom of demolition chamber 41 and, referring to FIGS. 3C and 3D, also forms the top of fogging chamber 51. Referring to FIGS. 3C, 6, 7 and 8, the top of sifter plate 47 contains numerous ¼ inch apertures. The sifter plate is positioned to have approximately 1/16 inch clearance at the point of closest approach between it and saw blades 45 or 445 and, if used, the hammers 33 or 432. The hammers 33 or 432 keep the larger waste particles airborne where they are subject to contacting the saw blades 45 and where the waste is shreded between the saw blades 45 and the sifter plate 47. Waste that has been crushed and shredded falls into the bottom of the demolition chamber 41 where particles come in contact with sifter plate 47. Particles too large to pass through the sifter plate 47 are trajected back into the cutting edges of the saw blades 45 or 445 and, if used, by the hammers 33 or 432. Referring to FIG. 1, fogging chamber 51 is attached to the bottom of demolition chamber 41 and is also mounted to frame 11 by means of a bracket 50. Referring to FIGS. 3C and 3D, particles smaller than the aperture size of the sifter plate pass through the sifter plate 47 into the fogging chamber 51 to be decontaminated.

Referring to FIGS. 1, 3C and 3D, atomizers 58 and 59 are opposedly mounted on the outside of fogging chamber 51. Referring to FIG. 1, air compressor 52 is mounted on upper mounting plate 14 and can be any one of a variety of commercially available air compressors that provides sufficient air volume and pressure, to be based on the concentration and volume of the selected sterilant. In the preferred embodiment, air compressor 52 supplies approximately 6 CFM at 40 psi. Air is taken into the air compressor 52 through the air intake 53. The compressed air is fed through compressed air tube 54, through pressure reading relay 56 and arriving at atomizer 58 and also through compressed air tube 55, through pressure reading relay 57, and, referring to FIG. 3D, arriving at atomizer 59. When pressure reading relays 56 and 57 detect sufficient air pressure, they send a sufficient air pressure status signal to control box 90.

Referring to FIG. 1, resting on the lower mounting plate 13 is liquid sterilant reservoir 61 which stores approximately five gallons of liquid sterilant. Metering pump 62 draws liquid sterilant from reservoir 61 through sterilant tubing 60. Metering pump 62 then pumps sterilant through sterilant tube 64, through flow meter device 66 to the atomizer 58 and also through sterilant tube 63, through flow meter device 65, and referring to FIG. 3D, to the atomizer 59. While sterilant is flowing through flow meter devices 65 and 66, a sterilant present status signal is sent to control box 90.

Referring to FIGS. 3C and 3D, fogging ports 68 and 69 are openings on opposite sides of fogging chamber 51, on the same sides, respectively, as the atomizers 58 and 59. Atomizers 58 and 59 combine the compressed air and liquid sterilant and discharge the atomized sterilant into the fogging chamber 51 through fogging ports 68 and 69, creating an environment of concentrated sterilizer fog in fogging chamber 51. Waste that has fallen through the sifter plate 47 into the fogging chamber 51 is guaranteed to be exposed to the sterilant as the waste continues its fall.

Figure 9:
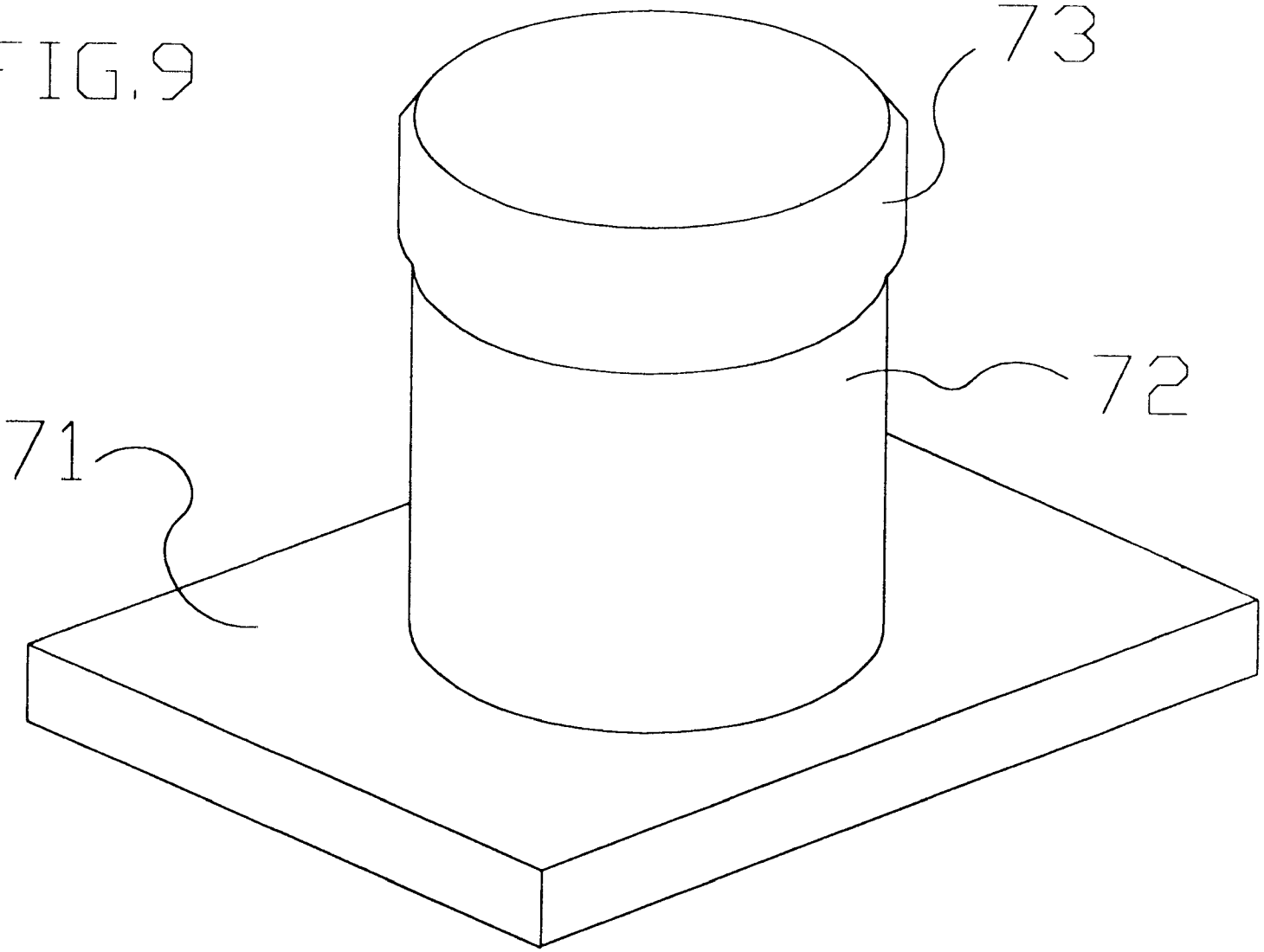
FIG. 9 is a view of the biodegradable bag in the container that is resting on the roller/platform assembly of the machine of FIG. 1.

Referring to FIGS. 1 and 9, roller/platform 71 is attached to lower mounting plate 13. Container 72, of approximately five gallon capacity, rests on roller/platform 71. Biodegradable plastic bag 73 lines container 72. Waste that has fallen through the fogging chamber 51 continues its fall into the biodegradable plastic bag 73 that lines container 72. The weight of the filling bag inside the container is measured by load cells 74. When the load cells 74 sense a predetermined weight, the load cells 74 send a filled bag status signal to control box 90. As an alternative, one skilled in the art could substitute for the load cells 74 an electronic depth gauge to monitor the height of the sterilized waste in the container 72. In that case, when the container 72 is filled to a predetermined height, the depth gauge would send the filled bag status signal to the control box 90.

Referring to FIG. 1, lever 75 releases roller/platform 71 so that container 72, still containing filled biodegradable plastic bag 73, can slide beyond frame 11 while still resting on the roller/platform 71. The biodegradable bag 73, containing shredded, decontaminated waste, can now be sealed and transported to any land fill.

Referring to FIGS. 10, 10A and 11 of the preferred embodiment, surrounding and completely encasing the biohazardous waste processor 100 is encasement 200. The encasement 200 can be made in a variety of materials and a variety of structures but the encasement 200 of the preferred embodiment has a light metal or plastic frame 211. Frame 211 has openings to receive doors and panels. Referring to FIG. 10A, while the back of frame 211 can be either a panel, door or solid, in this embodiment frame 211 has a solid back.

Referring to FIG. 11, panel 216 is mounted on the left side of encasement 200. In the preferred embodiment, frame 211 has, on the left side, one removable bottom member 215, such that when it and panel 216 are removed, the biohazardous waste processor 100 can be removed from the encasement 200. In the preferred embodiment, the biohazardous waste processor 100 can be removed while the encasement remains stationary; alternatively, the biohazardous waste processor 100 can remain stationary while encasement 200 is removed.

Referring to FIGS. 10 and 11, doors 201, 202, 203, 204, and 205, and panels 206, 207, 208, 209, 210, 212, 216, and 217, preferably made of light metal or plastic, are to facilitate the operation and maintenance of the machine.

Referring to FIGS. 1, 10 and 11, panel 210 fits into the top left opening of frame 211. Door 201 is hingedly mounted on frame 211 and positioned above the hopper area of apparatus 100 such that hopper cover 22 can be opened to permit bio-hazardous waste to be put into hopper 21.

Referring to FIGS. 10 and 11, panel 212 fits into the top right opening of frame 211. Panel 206 is mounted to the front upper left opening of frame 211. Hingedly mounted on panel 206 is door 202. Panel 207 is mounted to the front upper right opening of frame 211. Door 203 has a glass panel 222 to enable a machine operator to check the status lights on the control panel. Door 203 is hingedly mounted on panel 206. Panel 208 is mounted to the front lower left opening of frame 211. Hingedly mounted on panel 208 is door 204. Door 204 must be sufficiently large to allow the container 72 and roller/platform 71, to slide out. Panel 209 is mounted to the front lower right opening of frame 211. Hingedly mounted on panel 209 is door 205. Door 205 must be sufficiently large to remove, refill and replace the liquid sterilant reservoir 61 and the liquid nitrogen canister 81 of apparatus 100 in FIG. 1. Doors 201–205 have interlocks 214 that send closed door status signals to control box 90.

Referring to FIG. 11, air intake 225 is mounted on panel 216. Referring to FIG. 10, panel 217 is mounted to the right side of frame 211. Attached to side panel 217 is buzzer 250. If the bio-hazardous waste processor 100 was to be used without enclosure 200, buzzer 250 would be mounted in a suitable location such as attached to control panel 90. Air cleaner 223 reduces any pressure build-up due to vaporization of sterilant or evaporation of coolant, and allows this pressure to be reduced to approximately room air pressure; it maintains a closer balance to the differential between the internal pressure and the atmospheric pressure. Air cleaner 223 is selected from one of a number of commercially available air cleaners such as electronic, chemical or specialized filters, depending upon the local requirements of the facility. In the preferred embodiment, air cleaner 223 contains a standard HEPA filter. Air cleaner 223 is mounted on the panel 217. Air intake 225 provides air so that there will be some movement of air towards air cleaner 223 when the system is operating. Air intake 225 serves to prevent strain on air cleaner 223 and air compressor 52 and to maintain a closer balance to the differential between the internal pressure and the atmospheric pressure. The air cleaner 223 runs a predetermined length of time after the processor has shut down in order to ensure proper cleansing of the internal air, which time, in the preferred embodiment, is 10 minutes.

Referring to FIGS. 10 and 11, panels 206, 207, 208, 209, 210, 212, 216 and 217 are attached to frame 211 with quick disconnect fasteners 213 and have interlocks 214 that send closed panel status signals to control box 90.

Still referring to FIGS. 10 and 11, movability is provided by wheels and in the preferred embodiment by vertically retractable casters 251 which are attached to the lower portion of each leg of frame 211. The bottom of the encasement 200 must be sealed to prevent air leakage. Referring to FIGS., 10, 10A and 11, the bottom sealer in this embodiment is gasket 255, made of materials such as rubber and in the preferred embodiment is soft plastic, mounted along the bottom of frame 211. The vertically retractable casters 251 are raised by turning turn screw vertical threaded shaft nut 252 counter clockwise. Vertically retractable casters 251 must be retractable enough to lower the encasement frame 211 sufficiently to compress gasket 255 into forming an airtight seal around the base of the encasement.

Referring to FIG. 12, control box 90 status lamp 91 lights if the hopper closed 10 status signal is not received. Status lamp 92 lights if the sterilant flow status signal is not received. Status lamp 93 lights if the sufficient air pressure status signal is not received. Status lamp 94 lights if the bag filled status signal is received. Status lamp 95 lights unless all door interlocks send a closed door status signal. Status lamp 96 lights unless all panel interlocks send a closed panel status signal. Status lamp 97 lights unless sufficient cooling agent pressure is maintained.

Depressing power on button 99 begins the machine startup sequence. The machine startup sequence has a time delay which allows for door 203 to be closed without halting the machine startup sequence. After the power on time delay runs out, the control panel 90 reads the closed door, closed panel and hopper closed status signals. If any of them are missing, the appropriate status lamps, 91, 92 and/or 93 are lit, an alarm signal is sent to buzzer 250, providing an audible alarm, and machine startup is halted until the problem is corrected. At this time the control panel 90 also checks the bag filled status signal. If this status signal is present, the status lamp 94 is lit, an alarm signal is sent to buzzer 250, providing an audible alarm, and machine startup is halted until the problem is corrected. Next, the machine startup sequence energizes coolant pressure control 83. If coolant pressure relay 84 fails to detect sufficient pressure, the coolant pressure low signal is sent to control panel 90, causing an audible alarm and the coolant pressure low lamp 97 to be lit and stopping the sequence until the problem is corrected. Next, the machine startup sequence turns on air compressor 52, metering pump 62 and air cleaner 223. After a suitable time delay, the control panel 90 checks the sufficient air pressure and the sterilant flow status signals. If either of them are missing, the appropriate status lamps, 93 and/or 92, are lit, an alarm signal is sent to buzzer 250, providing an audible alarm, and machine startup is halted until the problem is corrected. After a delay of about 10 minutes to allow the waste to become brittle from the coolant, the machine startup sequence starts motors 24 and 43. The status signals are constantly monitored to detect a problem. If a problem is detected, the appropriate status lamp is lit, an alarm signal is sent to buzzer 250, providing an audible alarm, and machine startup is halted until the problem is corrected. Once the problem is corrected, the power on button 99 can be depressed to begin the machine startup sequence again.

Although the present invention has been described in considerable detail with reference to certain preferred versions thereof, other versions are possible. Therefore, the spirit and scope of the appended calims should not be limited to the description of the preferred versions contained herein.

What is claimed is:

1. An apparatus for shredding and decontaminating medical waste, the apparatus comprising:

(a) a coolant supply;

(b) a hopper to receive waste, the hopper having at least one port through which coolant is applied to the waste to make the waste brittle;

(c) a crusher located towards the base of the hopper to reduce the particle size of the waste;

(d) a down chute that receives the crushed waste, the down chute having at least one port through which coolant is applied to keep the waste brittle;

(e) a demolition chamber which receives the waste from the down chute, the demolition chamber having at least one port through which coolant is applied to the waste to keep the waste brittle;

(f) a coolant supply delivery system to the hopper, the chute and the demolition chamber;

(g) at least one shredder implement mounted in the demolition chamber;

(h) a sifter plate, having numerous apertures, that forms the bottom of the demolition chamber and limits the size of the waste particles leaving the demolition chamber;

(i) a fogging chamber that receives the waste through the sifter plate, the fogging chamber having at least one port through which sterilant is applied;

(j) a sterilant supply;

(k) a sterilant delivery system to the togging chamber;

(l) a waste receiver positioned to receive waste from the fogging chamber.

2. An apparatus as in claim 1 further comprising a control box, the control box comprising equipment to control the operation of the apparatus, and display operational and safety conditions.

3. An apparatus as in claim 1 further comprising a control box comprising equipment to control the operation of the apparatus and an optional encasement, and display operational and safety conditions.

4. An apparatus as in claim 1 wherein the crusher is a crushing wheel and dead plate.

5. An apparatus as in claim 1 wherein the coolant supply is a canister of liquid nitrogen.

6. An apparatus as in claim 1 wherein the coolant supply delivery system comprises a tubing with orifices open to at least one hopper port, at least one down chute port and at least one demolition chamber port.

7. An apparatus as in claim 1 wherein the shredder implement is comprised of one or more hammers alternating with one or more standard commercially available off-the-shelf saw blades where the hammers rotate in the same direction as the saw blades.

8. An apparatus as in claim 1 wherein the shredder implement is comprised of one or more hammers alternating with one or more standard commercially available off-the-shelf saw blades where the hammers rotate in the opposite direction of the saw blades.

9. An apparatus as in claim 1 wherein the shredder implement is comprised of one or more commercially available off-the-shelf dado saw blades such that if a plurality of dado blades are used, they alternate in direction of rotation.

10. An apparatus as in claim 1 wherein the sifter plate apertures are approximately ¼ inch in diameter.

11. An apparatus as in claim 1 wherein the sterilant delivery system comprises at least one atomizer producing a sterilant fog through at least one port of the fogging chamber.

12. An apparatus as in claim 1 wherein the sterilant delivery system comprises an air compressor and at least one atomizer.

13. An apparatus as in claim 1 where the waste receiver is comprised of a container lined with a biodegradable bag.

* * * * *